United States Patent [19]

Yokozeki

[11] Patent Number: 4,520,251

[45] Date of Patent: May 28, 1985

[54] METHOD FOR OPERATING A PROGRAMMABLE MICROWAVE HEATING APPARATUS WITH FOOD DEFROSTING CONTROL

[75] Inventor: Seiki Yokozeki, Yamatokoriyama, Japan

[73] Assignee: Matsushita Electric Industrial Co., Ltd., Kadoma, Japan

[21] Appl. No.: 606,553

[22] PCT Filed: Nov. 6, 1981

[86] PCT No.: PCT/JP81/00321

§ 371 Date: Jul. 9, 1982

§ 102(e) Date: Jul. 9, 1982

[87] PCT Pub. No.: WO82/01800

PCT Pub. Date: May 27, 1982

Related U.S. Application Data

[63] Continuation of Ser. No. 403,589, Jul. 9, 1984, abandoned.

[30] Foreign Application Priority Data

Nov. 10, 1980 [JP] Japan ..... 55-158594

[51] Int. Cl.[3] ..... H05B 6/68

[52] U.S. Cl. ..... 219/10.55 M; 219/10.55 B; 99/325; 426/243

[58] Field of Search ..... 219/10.55 M, 10.55 B, 219/10.55 R, 10.55 E, 492, 518, 506; 99/325, 327, 332, 451, DIG. 14; 426/243, 241, 524

[56] References Cited

U.S. PATENT DOCUMENTS

| | | | |
|---|---|---|---|
| 3,470,942 | 10/1969 | Fukada et al. | 219/10.55 B |
| 4,011,428 | 3/1977 | Fosnough et al. | 219/10.55 B |
| 4,130,749 | 12/1978 | Tanaka et al. | 219/10.55 B |
| 4,210,795 | 7/1980 | Lentz | 219/10.55 R X |
| 4,224,685 | 9/1980 | Sasaki et al. . | |
| 4,230,731 | 10/1980 | Tyler | 219/10.55 B |
| 4,255,639 | 3/1981 | Kawabata et al. | 219/10.55 B |
| 4,390,768 | 6/1983 | Teich et al. | 219/10.55 R X |
| 4,453,066 | 6/1984 | Mori | 219/10.55 M |

FOREIGN PATENT DOCUMENTS

| | | |
|---|---|---|
| 2917214 | 11/1979 | Fed. Rep. of Germany . |
| 49-129937 | 12/1974 | Japan . |
| 50-84941 | 7/1975 | Japan . |
| 52-103737 | 8/1977 | Japan . |
| 52-154140 | 12/1977 | Japan . |
| 430402 | 8/1967 | Switzerland . |

OTHER PUBLICATIONS

"A Microprocessor Control for Microwave Oven", Industrial Applications of Microprocessors, Mar. 20–22, 1978.

"Industrial Application of Microprocessors", Editor—Dr. Sotirios, J. Vahaviolos, Philadelphia, PA, Mar. 20–22, 1978.

*Primary Examiner*—Philip H. Leung

*Attorney, Agent, or Firm*—Wenderoth, Lind & Ponack

[57] ABSTRACT

A high frequency heating appliance which is capable of defrosting frozen food through the utilization of high frequency energy is provided with the facility of defrosting food quickly and satisfactorily in a state substantially similar to natural defrosting through a combination of a high frequency heating properties and the programming and controlling functions of a microcomputer.

4 Claims, 7 Drawing Figures

METHOD FOR OPERATING A PROGRAMMABLE MICROWAVE HEATING APPARATUS WITH FOOD DEFROSTING CONTROL

This application is a continuation of now abandoned application Ser. No. 403,589, filed July 9, 1984.

BACKGROUND OF THE INVENTION

This invention relates to a high frequency heating appliance capable of defrosting frozen food, for example, through the use of high frequency energy, and more particularly to a high frequency heating appliance capable of defrosting chilled food under a state approximately equal to natural defrosting for a brief period of time due to a combination of heating performance of high frequency energy and the programming and controlling functions of a microcomputer.

High frequency heating appliances of the above described type whose sequence of heating is governed under a microcomputer are already on the market. Microcomputer-aided setting of the heating and cooking modes require the operator to actuate a selected one of the heating mode selection keys and a selected one of the heating period selection keys for determining the amount of high frequency output, that is, the heat output and heating time and thus requires a complex and inconvenient setting operation.

With the above described method, the operator must have a look at a cook book, an appendix of the high frequency heating appliance, and then determine the heating output and time in introducing heating output and time settings as well as the kind of food.

Generally speaking, when food is heated with high frequency energy, the phenomenon takes place wherein the surface of food tends to absorb a greater amount of high frequency energy and is heated more quickly than the central portion thereof. One of the conventional approaches to overcome the phenomenon is to defrost the food slowly with a low level (say, 240 W) of high frequency output or to set up a given period of standing shortly after the surface temperature of the food has reached a predetermined value and high frequency output has been interrupted, with the intention of alleviating and minimizing the difference between the surface and internal temperatures of the food (cf. FIG. 1).

The conventional method as stated above, however, requires a complicated actuating procedure and a substantial amount of time. Furthermore, though the degree of excessive or insufficient defrosting is different to some extent, there is still the undesirable phenomenon wherein the surface of the food is excessively defrosted but the central portion of the food is less defrosted. For example, chilled raw fish, cakes, etc. are hardly palatable even when being defrosted. It is further appreciated that the appearance of defrosted meet is too poor to stimulate appetite and does not encourage a cook to serve delicious and tasty food. When a cooking procedure is conducted subsequent to defrosting, the surface of the food is overheated but the central portion thereof is insufficiently heated. No better cooking is expected.

SUMMARY OF THE INVENTION

Accordingly, it is an object of the present invention to provide a high frequency heating appliance capable of defrosting food in an almost natural defrosting state for a short period of time through a combination of high frequency heating performance and the programming and controlling functions of a microcomputer.

Specific embodiments of the present invention will now be described with reference to the accompanying drawings.

DESCRIPTION OF THE PREFERRED EMBODIMENT

Figure 1:
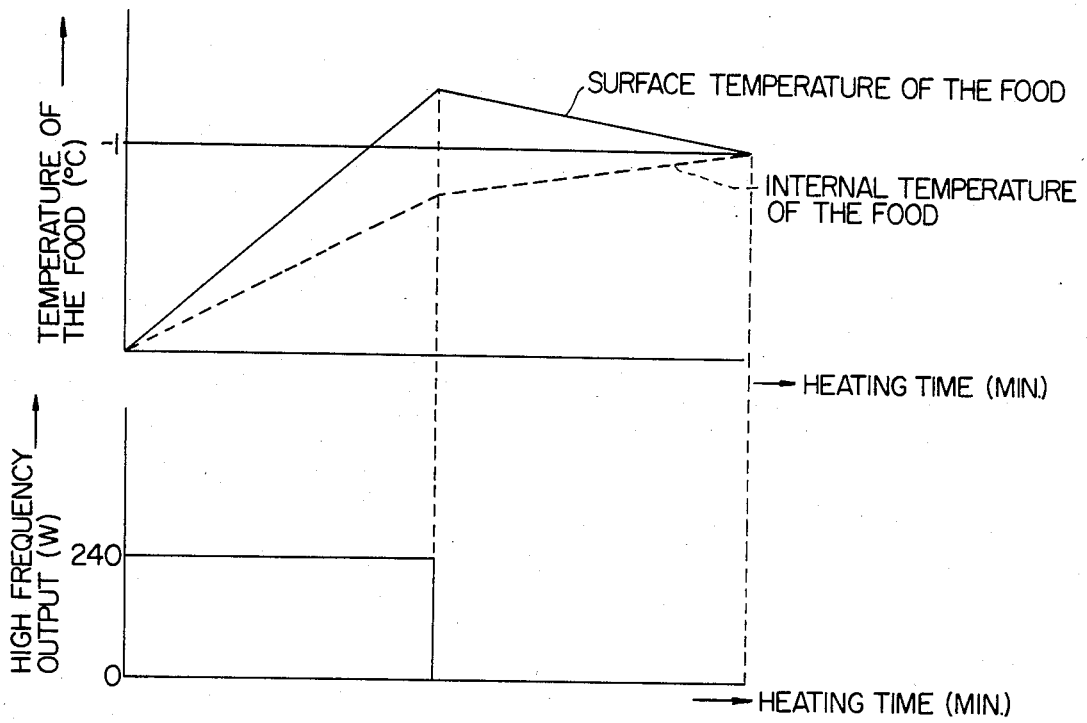
FIG 1. PRIOR ART
FIG. 1 is a graphic representation of the relation between heating time and heating temperature and high frequency output for explaining the conventional defrosting process.
Figure 2:
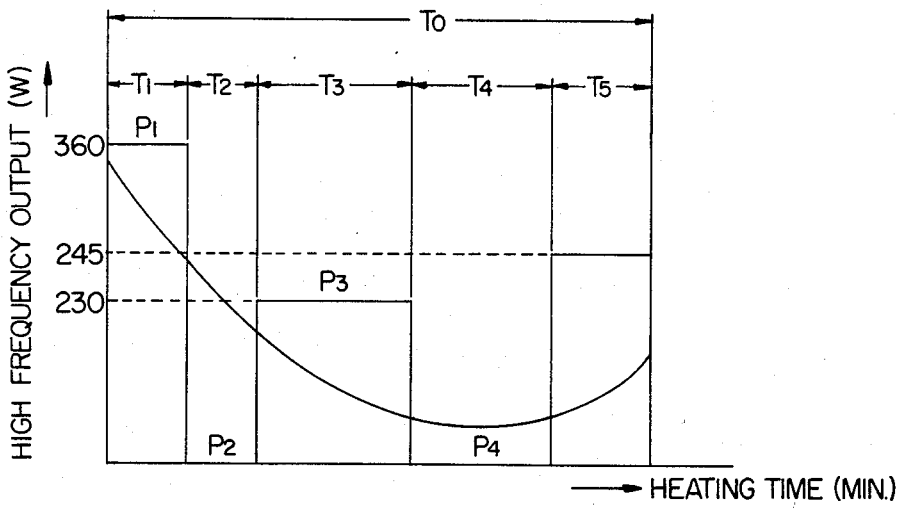
FIG. 2 is a graph showing the relationship between defrosting time and high frequency output for explaining the concept of the present invention.

The present invention has relied upon the findings of a variety of cooking tests conducted in an attempt to overcome the prior art problems as discussed above and offers an effective and quick defrosting way to further enhance the effect of repeated heating on the interior of food and minimizes the difference between the surface and internal temperatures of the food, provided that the food is heated initially with a high level of high frequency output and then with a slowly decreasing level of high frequency output and eventually up to −1°C or so in the course of defrosting where the interval of heating is divided into five time slots ($T_1$–$T_5$) and defrosting proceeds step-by-step from the first slot through the fifth slot, as indicated in FIG. 2.

A high frequency heating appliance embodying the present invention will now be detailed with regard to its structure and control system.

Figure 5:
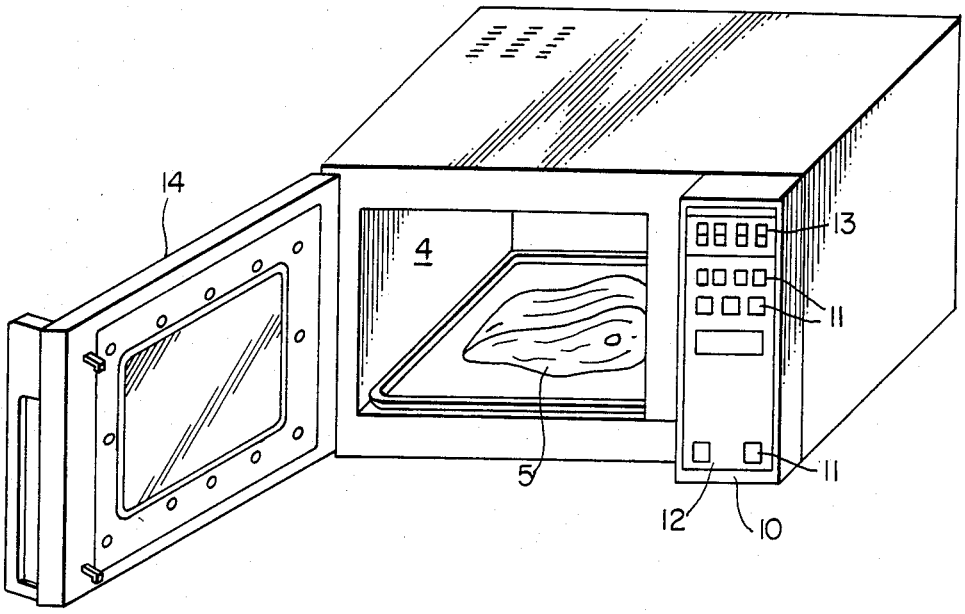
FIG. 5 is a perspective view of a high frequency heating appliance according to the first embodiment of the present invention, with a door in open position.
Figure 6:
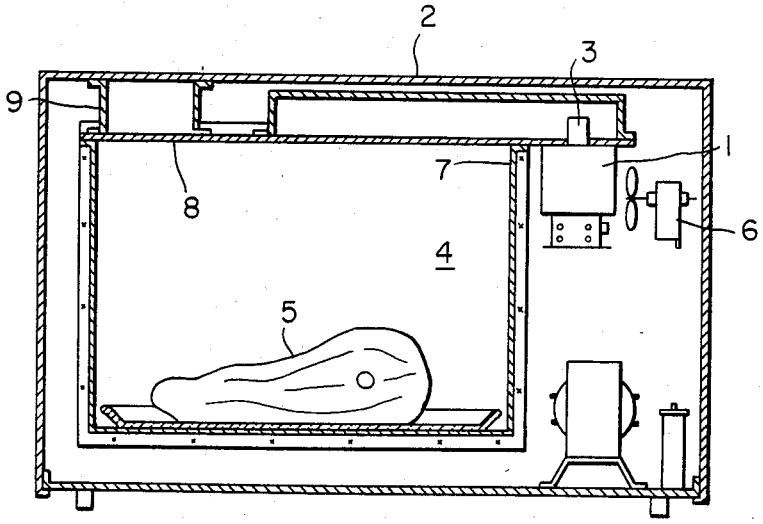
FIG. 6 is an elevational cross sectional view of the appliance.

Referring to FIGS. 5 and 6, a high frequency oscillator 1 of the design that provides microwave oscillation at 2450 MHz, for example, is coupled via a metal-made waveguide 2 and an antenna 3. High frequency waves from the high frequency oscillator 1 are directed into the waveguide 2 and radiated toward the interior of a heating chamber 4 after traveling through the waveguide 2. The high frequency waves effect dielectric heating on food 5 from inside while being absorbed by the food 5 mounted within the heating chamber 4. The high frequency oscillator 1 is subject to self-heating due to its internal losses and is therefore cooled by a blower fan 6 to prevent faulty operation during oscillation. Having cooled the high frequency oscillator 1, air fed via the blower fan passes through perforations 7 in a wall of the heating chamber 4 and enters the heating chamber 4. The air in the heating chamber 4 traverses perforations 8 in a wall of the heating chamber 4 while carrying steam generated from the food 5 during high frequency heating. The air is then discharged to the exterior of the high frequency heating appliance after traveling through the heating chamber 4 and a drain guide 9 communicating between the interior and exterior of the high frequency heating appliance.

A control panel 10 as shown in FIG. 5 carries a keyboard 12 including a plurality of key pads which are manually operable by the user for introducing heating output, heating time and heating mode settings and further including display elements 13 such as LEDs and fluorescent display tubes for displaying the heating output, time and mode settings. A freely openable and closable door 14 as shown in FIG. 5 provides access to the heating chamber 4 for the food 5.

The foregoing has set forth the structure of the high frequency heating appliance to which the present invention is applied. A control circuit of the high frequency heating appliance will now be described by reference to FIG. 7.

The high frequency heating appliance is usually plugged into a plug receptacle in a house for supplying power via a power plug. One end 15 of the power plug is connected to a fuse 16 which will operate in response to the operation of a short switch 22 for preventing leakage of a substantial amount of microwaves if any electric components of the high frequency heating appliance is short-circuited or grounded or an interlock as described below becomes melted. Furthermore, the interlock 17 whose contact is opened and closed upon the opening and closing of the door 14 is connected to the fuse 16. The interlock 17 is also connected to a relay 18 which is switched on to interrupt heating in response to a heating start command from a microcomputer and switched off in response to an end command. The relay 18 is connected to a second interlock 19 whose contact is opened and closed upon movement of the door 14. The interlock 19 is connected to a primary winding 21 of a high voltage transformer 20. Connected across the primary winding 21 of the high voltage transformer 20 are the blower fan 6 for cooling the high frequency oscillator 1 and the above mentioned short switch 22 which works to render the entire circuit inoperable when the interlock becomes melted. The remaining end 23 of the power plug is connected directly to the primary winding 21 of the high voltage transformer 20. An AC power input to the high voltage transformer 20 is boosted into a high voltage power output through operation of the high voltage transformer 20. The resultant high voltage power output is multiplied and rectified into a high voltage DC power output through a voltage multiplier and rectifier composed of a high voltage capacitor 24 and a high voltage diode 25. The high voltage DC power output is fed to the high frequency oscillator 1 via a high voltage switch 26 switchable in a given cycle, to thereby permit the amount of the high frequency output to be variable. The switching of the high voltage switch 26 is governed by the microcomputer 30. The high voltage DC power output supplied to the high frequency oscillator 1 is converted into high frequency radiation in the high frequency oscillator 1 and the radiation is delivered from the antenna 3. The high frequency waves serve to heat the food 5 in the above described manner.

The high voltage transformer 20 further includes a heater winding 27 and a biquadratic winding 28, with the heater winding 27 leading to a heater 29 of the high frequency oscillator 1 for heating the heater. The function of the biquadratic winding 28 is to determine that the door 14 has been opened in the course of heating and the interlocks 17 and 19 have been switched off to interrupt AC power supply to the primary winding 21 of the high voltage transformer 20 and to inform the microcomputer of this finding and eventually disenergize the relay 18. It is noted that the relay 18 and the high voltage switch 26 are switched on and off in response to commands from the control circuit.

Figure 7:
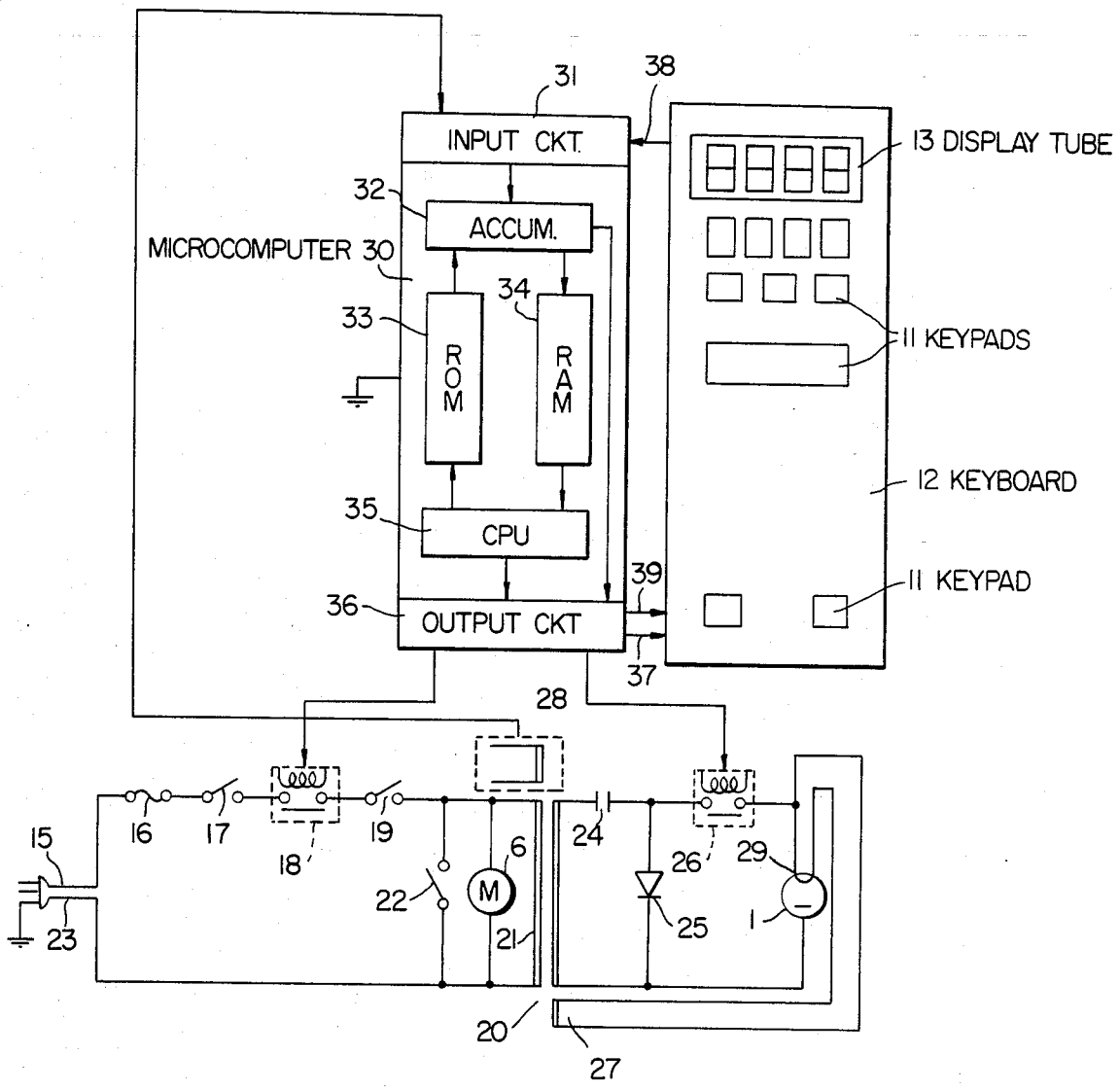
FIG. 7 is a circuit diagram of a control circuit of the high frequency heating appliance.

The control circuit will be described in detail by reference to FIG. 7. The microcomputer 30 in FIG. 7 plays an important role in the whole of the control circuit. The primary function of the microcomputer 30 is to control peripheral circuits, analyze and calculate information from the peripheral circuits and then control the peripheral circuits according to the results of such analysis and calculation. The microcomputer 30 has an input circuit 31 for receipt of the information characteristics of selected heating outputs, times and modes as introduced via the keyboard 12, a cooking interruption command from the biquadratic winding 28 of the high voltage transformer 20, etc.; an accumulator 32 for temporarily storing the commands, the information, etc. for comparison with data contained in a ROM area stated below, and transmission into a RAM or a central processing unit and so forth; a ROM 33 for storing all of the commands and information necessary for controlling the whole system; a RAM 34 for storing the information and data fed from the input circuit 31; a central processing unit 35 for analyzing and calculating the information, data and various commands; an output circuit 36 for delivering output signals for controlling the peripheral circuits according to the resultant data.

The output terminals 37 of the microcomputer 30 are connected so as to feed the output signals to the keyboard 12 and to especially feed a corresponding one of the output signals to an output terminal 37 of the keyboard 12 when a particular one of the key pads 11 on the keyboard 12 is depressed by the user. A signal received by an input terminal 38 is temporarily loaded into the accumulator 32 via the input circuit 31 of the microcomputer 30 for subsequent comparision with the data in the ROM 33, transmission to the RAM 34 or the central processing unit 35 and calculation in the central processing unit 35. If the case permits, signals resulting from the calculation are transferred from the output circuit 36 to the peripheral circuits to enable the same. Actuation of the keyboard by the user and, in other words, the information characteristic of the heating time and high frequency output settings is fed into the microcomputer 30, thus opening and closing the relay 18 in response to the heating time settings and switching the high voltage switch on and off in response to the high frequency output settings.

The output terminals 39 of the microcomputer 30 deliver the output signals to the display tubes 13 on the control panel 10 for the purpose of displaying the cooking output, time and modes settings. As stated previously, the microcomputer 30 plays an important role in the control circuit and especially controls the peripheral circuits, accepts, analyzes and calculates information from the peripheral circuits and further controls the peripheral circuits according to the results of such operations. Another important function of the microcomputer 30 is to convert input information into other information or commands.

Inasmuch as the level of the high frequency output is fixed, the period of heating the food may be correlated in a one-to-one relationship with the weight of the food 5. Should the heating times corresponding to respective weights of the food be stored in the microcomputer 30 and should key switches be provided on the keyboard 12 for setting the weight of the food, the user may introduce weight settings into the microcomputer 30 upon actuation of the weight setting key switches. The microcomputer 30 converts the weight information into a corresponding heating time and selects a corresponding level of the high frequency output. Afterward, when the user gives the heating start command to the microcomputer 30, the microcomputer 30 starts energizing the relay 18 and repeatedly switching the high voltage switch 26. Upon the completion of heating, the microcomputer 30 places the relay 18 into its off position and discontinues switching the high voltage switch 29. It is obvious to those skilled in the art that a semiconductor device such as a thyristor may be used instead of the high voltage switch 26.

Figure 3:
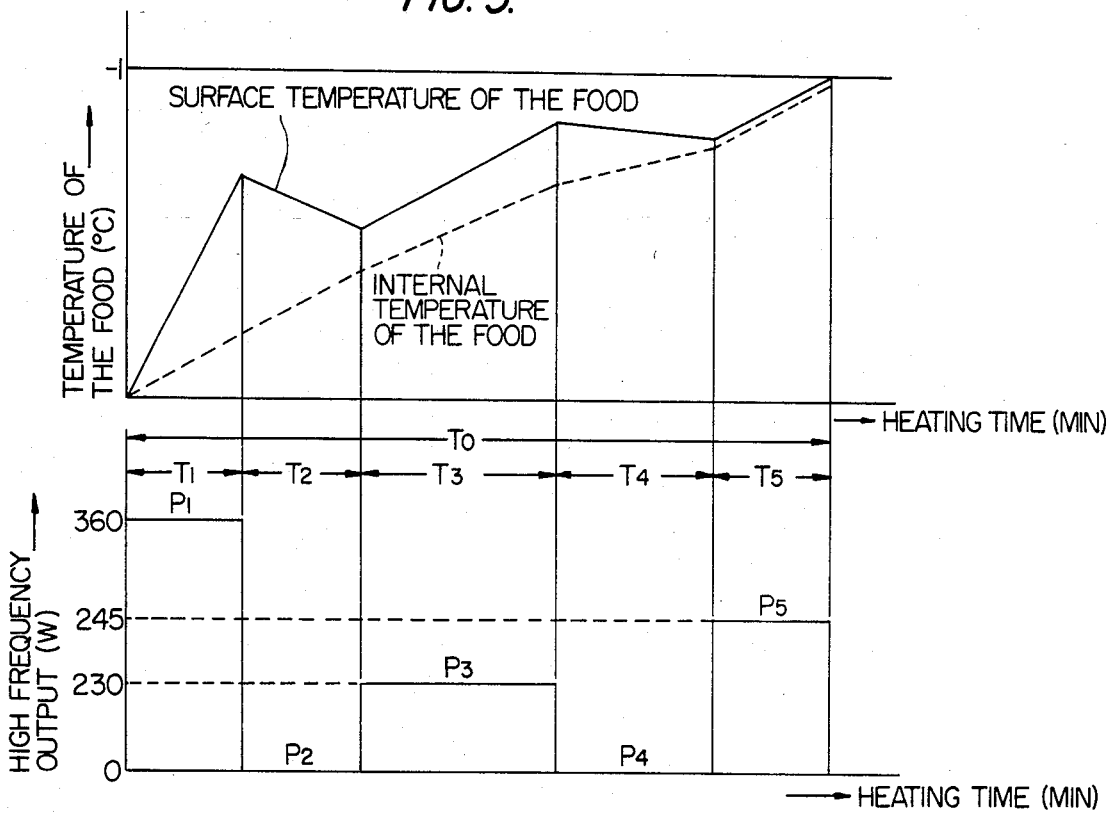
FIG. 3 is a graphic representation of the relationship between heating time and heating temperature and high frequency output for explaining a defrosting process according to an embodiment of the present invention.

The above circuit arrangement and the performance of the microcomputer make it possible for the user to set the weight of the food directly without calculating the heating time or without facing the prior art dificulty. In the past years, the process of defrosting the food was performed with a low level of high frequency output due to the high frequency absorbing properties of the chilled food. The process of defrosting therefore demanded a very long period of time and caused inconvenience of use due to the low level of high frequency output. The present invention provides an effective measure to avoid those problems. The process of defrosting according to the present invention will be detailed by reference to FIG. 3 which depicts temperature variations in the surface (as plotted by the solid line) and the central portion (as plotted by the dotted line) of the food as the heating time elapses together with the controlling of the high frequency output.

A total of defrosting time $T_0$ is segmented into the five time slots $T_1$, $T_2$, $T_3$, $T_4$ and $T_5$, with levels of the high frequency output in effect in the respective ones of the time slots being designated by $P_1$, $P_2$, $P_3$, $P_4$ and $P_5$, respectively.

As the heating time elapses, the microcomputer 30 switches the high voltage switch according to the output level $P_1$ during the time slot $T_1$ and switches the same according to the output levels $P_2$, $P_3$, $P_4$ and $P_5$ during the respective time slots $T_2$, $T_3$, $T_4$ and $T_5$. The relationship among the respective output levels $P_1$, $P_2$, $P_3$, $P_4$ and $P_5$ is as follows:

$$P_1 > P_5 \geqq P_3$$

$$P_2 = P_4 = 0$$

Generally, the amount of high frequency output absorbed at the central portion of the food at a distance r from the surface of the food is:

$$P_r = P_0 \epsilon^{-f\epsilon}$$

wherein $P_r$: the amount of high frequency output absorbed by the central portion of the food at the distance r from the surface thereof, $P_0$: the amount of high frequency output absorbed at the surface, and f: a linearly increasing constant.

The above formula indicates that the amount of high frequency energy absorbed is greater at the surface of the food than at the central portion thereof and the former is heated more quickly than the latter.

Should heating be started and the level of high frequency output be highest during the time slot $T_1$, the surface portion of the food is first heated and defrosted. During the time slot $T_1$, the temperature of the inside portion of the food increases much more slowly (i.e. with a time lag) than that of the surface portion thereof (as is clear from comparison between the solid line and the dotted line). The high frequency output level $P_2$ is reduced to zero during the next succeeding time slot $T_2$, so that heat accumulated in the surface portion is permitted to move toward the central portion to thereby decrease the temperature at the surface portion and increase continuously that at the central portion. The high frequency output during the next time slot $T_3$ is placed at the level $P_3$ which is substantially lower than the level $P_1$ during the time slot $T_1$. The level $P_3$ of the high frequency output is such that the surface temperature of the food is allowed to increase and the internal temperature is also allowed to rise sufficiently through transmission of heat accumulated from the surface portion to the inside portion. The high frequency output level is made equal to zero during the time slot $T_4$ in the same fashion as during the slot $T_2$ so that the heat accumulated at the surface portion is released toward the inside portion. The food is allowed to stand until the surface temperature equals the central temperature at the end of the time slot $T_4$. The level of the high frequency output during the last time slot $T_5$ is selected to be equal to or somewhat higher than the high frequency output level $P_3$ during the third time slot $T_3$ such that the surface temperature rises and the inside temperature also increases slowly due to heat transmission from the surface portion to the intake portion. Eventually, both the surface temperature and the internal temperature are brought up to an intended temperature (−1° C.).

Figure 4:
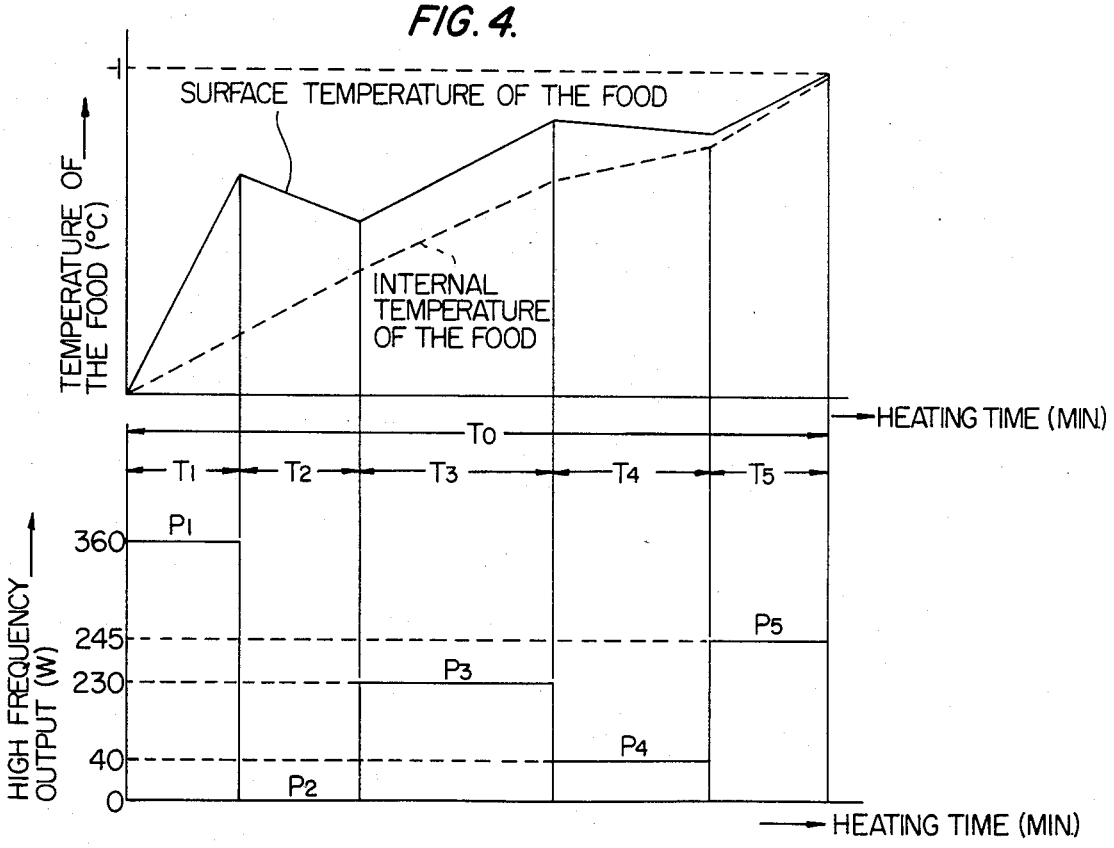
FIG. 4 is a graphic representation for explaining another embodiment.

Defrosting the food is completed in the above described manner in such a manner that both the surface portion and the internal portion of the food show an intended finishing temperature. Experiments actually using food make sure that the best results were found with meats when the respective microwave outputs $P_1$=360 W, $P_3$=230 W, $P_5$=230 to 245 W and $P_2$=$P_4$=0 W. Follow-up cooking tests with chicken as depicted in FIG. 4 further reveal that $P_1$=360 W, $P_2$=0 W, $P_3$=230 W, $P_4$=70 W and $P_5$=230 to 245 W in combination were most effective. As the findings of those experiments, the relationship between the surface temperature and the internal temperature of the food are true with the latter case.

As stated previously, the way of controlling the high frequency output gives the most effective and satisfactory results of defrosting. The use of the microcomputer provides a cost-saving and reliable way to attain the abovenoted complex controlling process.

Furthermore, although the respective output levels during the time slots are somewhat different dependent upon the kind of the food, the heating time is correlated in a one-to-one relation provided that the level of the high frequency output is fixed. Accordingly, through the provision of the category setting keys on the keyboard for selectoing the category of the food and the weight setting keys for selecting the weight of the food, the user can conduct the process of heating and cooking easily without consulting a cook book whenever cooking is to be started.

The microcomputer executes arithmetic operations to evaluate the heating times during the respective time slots, using the weight as an operand, and to evaluate a total of the heating times by summing up the heating times so evaluated as well as allowing the display tubes to show the results thereof. The total heating time on the display tubes is decremented every second in the course of food heating to indicate the remaining time directly, thus providing a users' convenience.

As noted earlier, the present invention permits all of the processes including heating sequence, treatment of information introduced via the category setting keys and the food weight setting keys, indication of the total heating time, etc., with the aid of the microcomputer. Since calculations on the weight of the food and the level of the high frequency output are performed with the microcomputer, there is provided a cost-saving, reliable and quick way to attain almost natural defrosting.

I claim:

1. A method for optimally defrosting food in a high frequency heating appliance, said appliance comprising:

a heating chammber for receiving food therein;

a high frequency oscillator for supplying a high frequency energy output to said heating chamber;

a microcomputer for storing information and for controlling said high frequency energy output of said high frequency oscillator in response thereto;

a plurality of keys for inputting information into said microcomputer;

a display operatively connected to said microcomputer for displaying information stored therein;

said method comprising the steps of:

storing a plurality of heating times in said microcomputer, each of said heating times corresponding to a weight of a particular food which has been previously stored by food type in said microcomputer, wherein each of said heating times is divided into five consecutive time slots $T_1$, $T_2$, $T_3$, $T_4$, and $T_5$;

storing in said microcomputer respective levels of the high frequency energy outputs of said high frequency oscillator $P_1$, $P_2$, $P_3$, $P_4$, and $P_5$, wherein said levels $P_1$–$P_5$ are arranged so as to respectively correspond to said slots $T_1$–$T_5$ and levels are arranged such that said levels $P_1$–$P_5$ are optimum for defrosting said particular food of said weight and such that $P_1 > P_5 \geqq P_3 > P_4 \geqq P_2$;

and, when an operator enters a weight of a particular food type into said microcomputer via said plurality of keys, controlling said high frequency energy oscillator with said microcomputer so as to operate in accordance with said corresponding heating times and high frequency energy level outputs which have been previously stored in said microcomputer so as to thereby optimize the defrosting of said food;

wherein said heating time and high frequency outputs are adjusted such that a surface temperature of said food does not exceed a predetermined final finishing temperature during its defrosting.

2. A method as set forth in claim 1, wherein said levels are arranged such that $P_4 = P_2 = 0$.

3. A method as set forth in claim 1, wherein said food type and weight of food and heating time are displayed on said display.

4. A method as set forth in claim 1, wherein said display displays the remaining heating time.

* * * * *